US006397938B1

(12) United States Patent
Nishishita

(10) Patent No.: US 6,397,938 B1
(45) Date of Patent: Jun. 4, 2002

(54) HEAT EXCHANGER

(75) Inventor: Kunihiko Nishishita, Konan (JP)

(73) Assignee: Zexel Corporation, Tokyo (JP)

( * ) Notice: Subject to any disclaimer, the term of this patent is extended or adjusted under 35 U.S.C. 154(b) by 0 days.

(21) Appl. No.: 09/609,312

(22) Filed: Jun. 30, 2000

(30) Foreign Application Priority Data

Jul. 8, 1999 (JP) ..... 11-194684

(51) Int. Cl.[7] ..... F28D 1/02; F28D 7/06; F28F 9/02

(52) U.S. Cl. ..... 165/153; 165/176; 165/173

(58) Field of Search ..... 165/153, 176, 165/167, 173

(56) References Cited

U.S. PATENT DOCUMENTS 4,589,265 A * 5/1986 Nozawa ..... 165/176
5,042,577 A * 8/1991 Suzumura ..... 165/153
5,544,702 A * 8/1996 Nishishita ..... 165/153
5,564,497 A * 10/1996 Fukuoka et al. ..... 165/152
5,701,760 A * 12/1997 Torigoe et al. ..... 165/153
5,735,343 A * 4/1998 Kajikawa et al. ..... 165/153
6,070,428 A * 6/2000 Higashiyama et al. ..... 165/153
6,145,587 A * 11/2000 Hanafusa ..... 165/153
6,170,567 B1 * 1/2001 Nakada et al. ..... 165/153

* cited by examiner

*Primary Examiner*—Henry Bennett
*Assistant Examiner*—Tho V Duong
(74) *Attorney, Agent, or Firm*—Wenderoth, Lind & Ponack, L.L.P.

(57) ABSTRACT

In a heat exchanger achieving a smaller width and constituted as a two-path heat exchanger having a first path through which the coolant travels from a first tank group to a second tank group and a second path through which the coolant travels from a third tank group to a fourth tank group to improve the temperature distribution in the heat exchanger and the heat exchanging capability, the coolant flows in opposite directions in the first path and the second path, the high-temperature area in the first path and the low temperature area in the second path are aligned with each other along the direction of the airflow and the high temperature area in the second path and the low temperature area in the first path are aligned with each other along the direction of airflow.

4 Claims, 6 Drawing Sheets

Cw
15
16
1
11
3
2
9
3
9
2
10
14
7
6
10
10
12
4
5
13
5
17
18
19

HEAT EXCHANGER

BACKGROUND OF THE INVENTION

The present invention relates to a heat exchanger constituting part of the freezing cycle in an air-conditioning system installed in a vehicle.

Heat exchangers of this type in the prior art include the laminated heat exchanger disclosed in Japanese Unexamined Utility Model Publication No. H 7-12778, which is achieved by laminating a pair of upper header portions, i.e., an upper front header portion and an upper rear header portion formed at one end in the lengthwise direction, a pair of lower header portions, i.e., a lower front header portion and a lower rear header portion formed at the other end along the lengthwise direction and a middle plate having flat tubes individually communicating between the upper front and upper rear header portions and the lower front and lower rear header portions via fins. In addition, a pair of upper tank groups constituted by laminating the upper front and upper rear header portions are each partitioned at an approximate center to be divided into two tank blocks. A pair of lower tank groups are constituted by laminating the lower front and lower rear header portions.

In the laminated heat exchanger with individual tank blocks formed by dividing the upper tank groups referred to as a first upper front tank block, a second upper front tank block, a first upper rear tank block and a second upper rear tank block, coolant enters the first upper front tank block through a fluid induction port, travels downward through the flat tubes to enter the lower front tank group and then travels upward through the flat tubes from the lower front tank group to enter the second upper front tank block. Next, the coolant bypasses a communicating portion 21 before entering the second upper rear tank block then enters the lower rear tank group by traveling downward through the flat tube from the second upper rear tank block, travels through the lower rear tank group and then moves upward through the flat tubes before flowing into the first upper rear tank block to flow out through a fluid discharge port.

However, in the heat exchanger in the prior art structured as described above, in which the coolant having flowed into the first upper front tank block travels down through the flat tubes to flow into the lower front tank group, travels through the lower front tank group and moves upward through the flat tube to reach the second upper front tank block, the quantity of coolant moving upward through the flat tubes located near the partitions is smaller than the quantity of coolant in other areas, resulting in the coolant temperature in this area rising higher. Likewise, the quantity of coolant traveling upward through the flat tubes located near the partitions is smaller than the quantity of coolant in other areas with regard to the coolant that travels downward from the second upper rear tank block to the lower rear tank group and moves through the lower rear tank group to travel upward to the first upper rear tank block resulting in the temperature in this area rising higher.

As described above, due to the reduction in the quantity of coolant near the partitions causing an increase in the temperature, a problem arises in that the temperature distribution in the vicinity of the center of the heat exchanger where the airflow quantity is most stable, becomes very poor. In particular, if the width of the heat exchanger itself is reduced to satisfy the increasing need for further miniaturization of the heat exchanger to be fitted inside a more compact air conditioning system, which, in turn, must be installed in reduced available space inside a vehicle, a deterioration in the temperature distribution in the vicinity of the center, which results in a great reduction in the heat exchanging capability, poses a serious problem.

Accordingly, an object of the present invention is to provide a thinner heat exchanger with good temperature distribution and high heat exchanging capability.

SUMMARY OF THE INVENTION

In order to achieve the object described above, the laminated heat exchanger according to the present invention comprising a plurality of tube elements each having a pair of one-end tank portions provided at one end in the lengthwise direction and a pair of other-end tank portions provided at the other end along the lengthwise direction, a first coolant passage communicating between one of the one-end tank portions and one of the other-end tank portions and a second coolant passage communicating between the other one-end tank portion and the other other-end tank portion and fins provided between the tube elements, is further provided with a first tank group constituted of tank portions in individual one-end tank portion pairs on one side that are in communication with each other along the laminating direction, which communicates with a coolant intake, a second tank group constituted of tank portions in the individual other-end tank portion pairs on one side that are in communication with each other along the laminating direction, a third tank group constituted of tank portions in the other-end tank portion pairs on the other side that are in communication with each other along the laminating direction, a fourth tank group constituted of tank portions in the one end tank portion pairs on the other side that are in communication with each other along the laminating direction, which communicate with a coolant outlet, a bypass passage communicating between the second tank group and the third tank group, a first path comprising a first coolant passage group constituted of the first coolant passages and extending from the first tank group to the second tank group and a second path comprising a second coolant passage group constituted of the second coolant passages and extending from the third tank group to the fourth tank group.

By adopting the structure described above, a two-path heat exchanger having the first path through which the coolant travels from the first tank group to the second tank group and the second path through which the coolant travels from the third tank group to the fourth tank group, in which the coolant flows in different directions in the first path and the second path, is achieved. Thus, the area over which the temperature rises high in the first path and the area over which the temperature is low in the second path are aligned relative to the direction of airflow and the area in which the temperature rises high in the second path and the area over which the temperature is low in the first path are aligned relative to the direction of airflow to improve the temperature distribution in the heat exchanger.

In addition, according to the present invention, it is desirable that the width of the tube elements along the direction of airflow be set in a range of 30–57 mm. It has been confirmed through testing that the heat exchanger structured as described above is capable of sustaining full heat exchanging capability with the width set within this range.

BRIEF DESCRIPTION OF THE DRAWINGS

The above and other features of the invention and the concomitant advantages will be better understood and appreciated by persons skilled in the field to which the invention pertains in view of the following description given in conjunction with the accompanying drawings which illustrate preferred embodiments. In the drawings.

DETAILED DESCRIPTION OF THE PREFERRED EMBODIMENTS

The following is an explanation of the preferred embodiments of the present invention, given in reference to the drawings.

Figure 1:
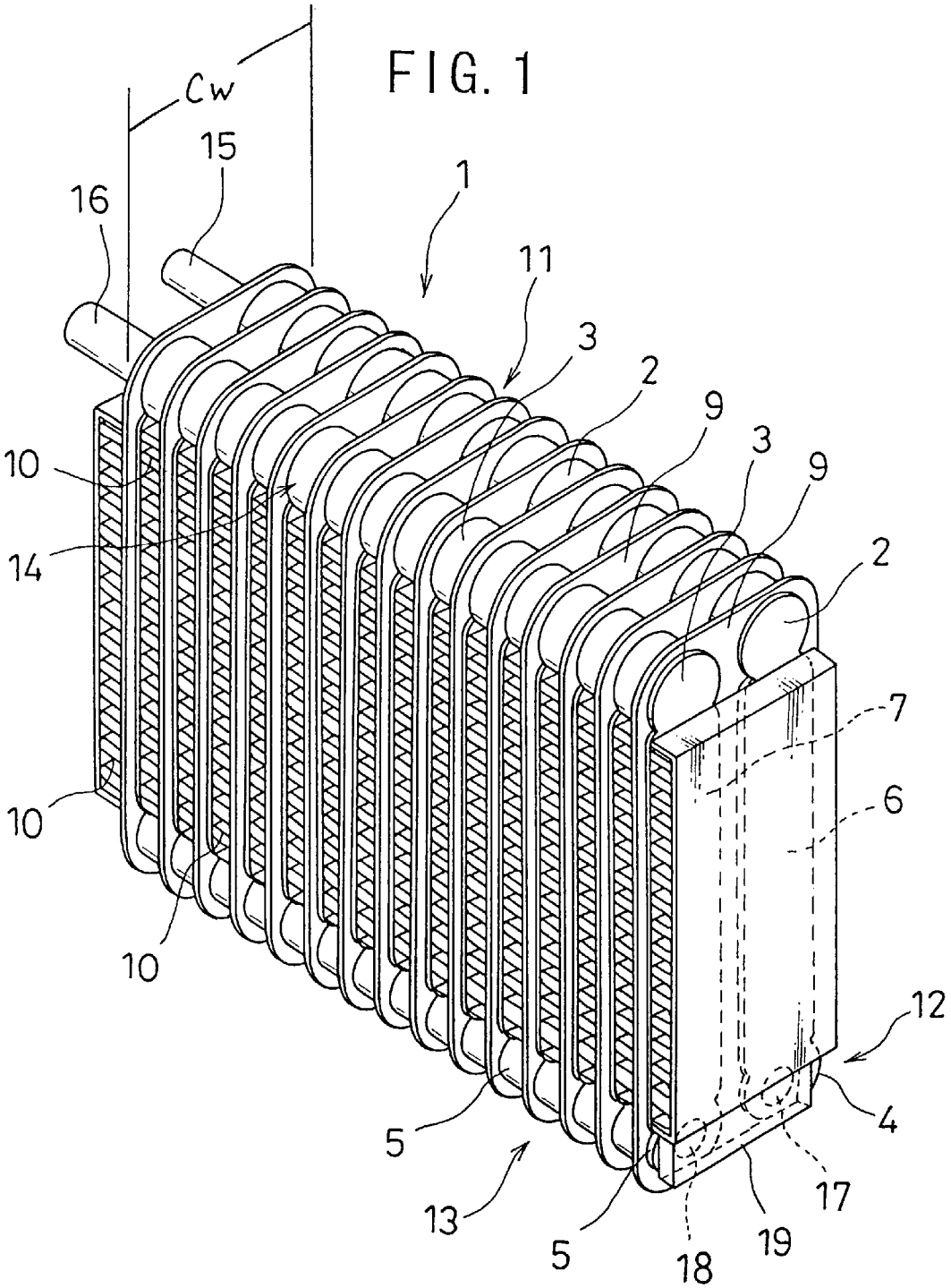
FIG. 1 is a perspective of the heat exchanger in a first embodiment of the present invention.

A heat exchanger 1 in FIG. 1 is a laminated heat exchanger achieved by alternately laminating a plurality of tube elements 9 and a plurality of fins 5 (to form a heat exchanger body portion), and is formed as an evaporator constituting part of a freezing cycle in this embodiment. The tube elements 9 are each provided with a pair of separate and discrete tank portions, i.e., a first tank portion 2 and a second tank portion 3, formed at one end (e.g. first longitudinal end) along the lengthwise direction, a pair of separate and discrete tank portions, i.e., a third tank portion 4 and a fourth tank portion 5, formed at the other end (e.g. second longitudinal end) along the lengthwise direction, a first coolant passage 6 communicating between the first tank portion 2 and the third tank portion 4 and a second coolant passage 7 communicating between the second tank portion 3 and the fourth tank portion 5.

In addition, the first tank portions 2 are made to communicate with each other along the laminating direction to constitute a first tank group 11, the third tank portions 4 are made to communicate with each other along the laminating direction to constitute a second tank group 12, the fourth tank portions 5 are made to communicate with each other along the laminating direction to constitute a third tank group 13 and the second tank portions 3 are made to communicate with each other along the laminating direction to constitute a fourth tank group 14.

Figure 2:
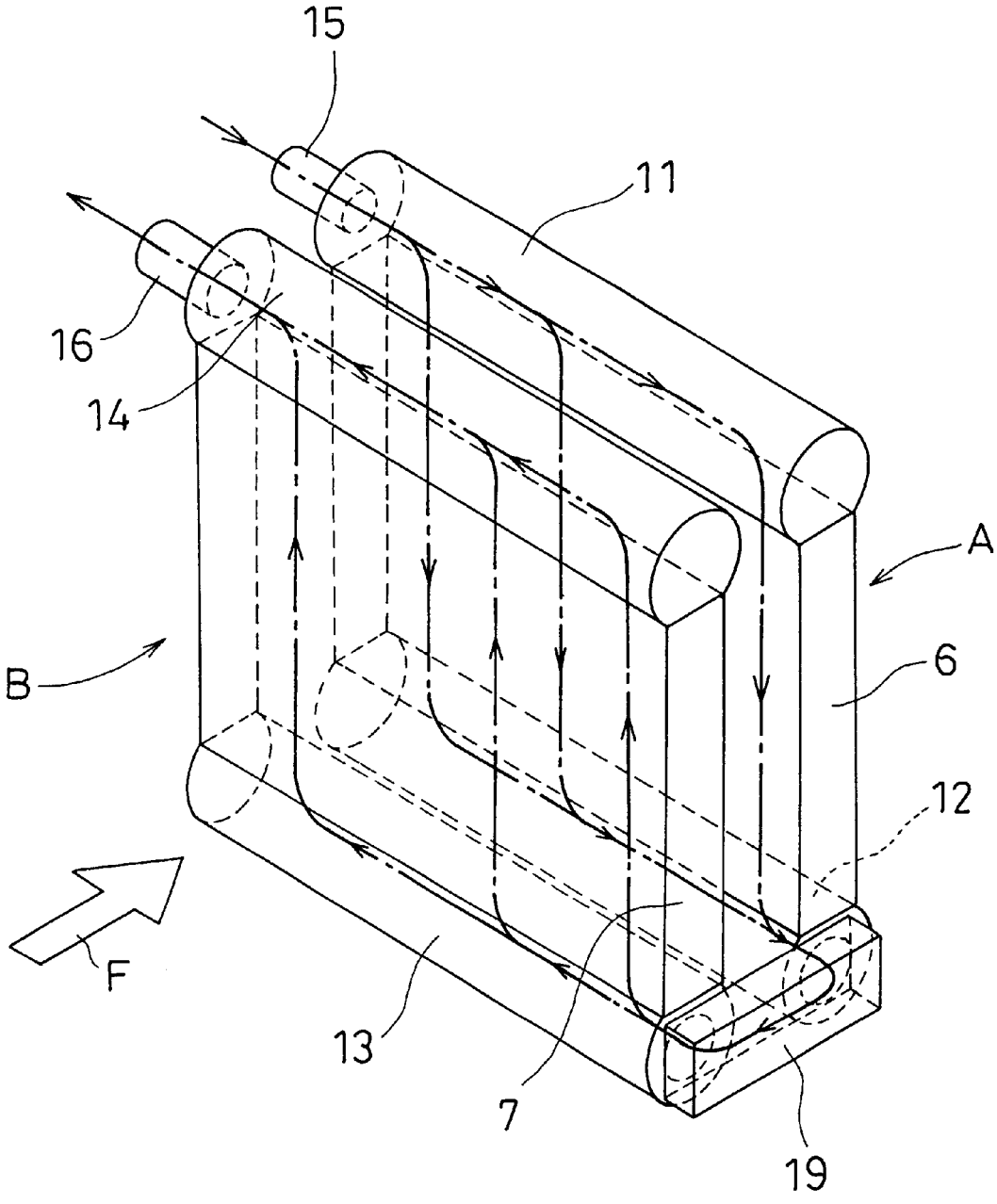
FIG. 2 is the schematic block diagram illustrating the flow of the coolant.

As illustrated in FIGS. 1 and 2, the first coolant passages 6 constitute a first coolant passage group A communicating between the first tank group 11 and the second tank group 12, and the second coolant passages 7 constitute a second coolant passage group B communicating between the third tank group 13 and the fourth tank group 14. The first tank group 12 and the third tank group 13 are made to communicate fluidly with each other by a coolant bypass passage 19 which communicates between a first communication opening 17 opening at one end of the second tank group 12 along the laminating direction and a second communication opening 18 opening at one end of the third tank group 13. the second tank group 12 fluidly communicates with a coolant inflow pipe 15 at the other end along the laminating direction and the fourth tank group 14 fluidly communicates with a coolant outflow pipe 16 at the other end along the laminating direction.

Thus, the coolant having flowed into the first tank group 11 through the coolant inflow pipe 15 travels inside the first tank group 11 and also passes through the first coolant passages 6 constituting the first coolant passage group A (and which defines a first pass of a two-pass heat exchanger, as shown in FIG. 2) to flow into the second tank group 12. It then moves through the second tank group 12, flows inside the coolant bypass passage 19 and reaches the third tank group 13. Then, the coolant moves through the third tank group 13, also passes through the second coolant passages 7 constituting the second coolant passage group B (and which defines a second pass of the two-pass heat exchanger) to reach inside the fourth tank group 14 and travels through the fourth tank group 14 to be delivered for the next process through the coolant outflow pipe 16.

Figure 3:
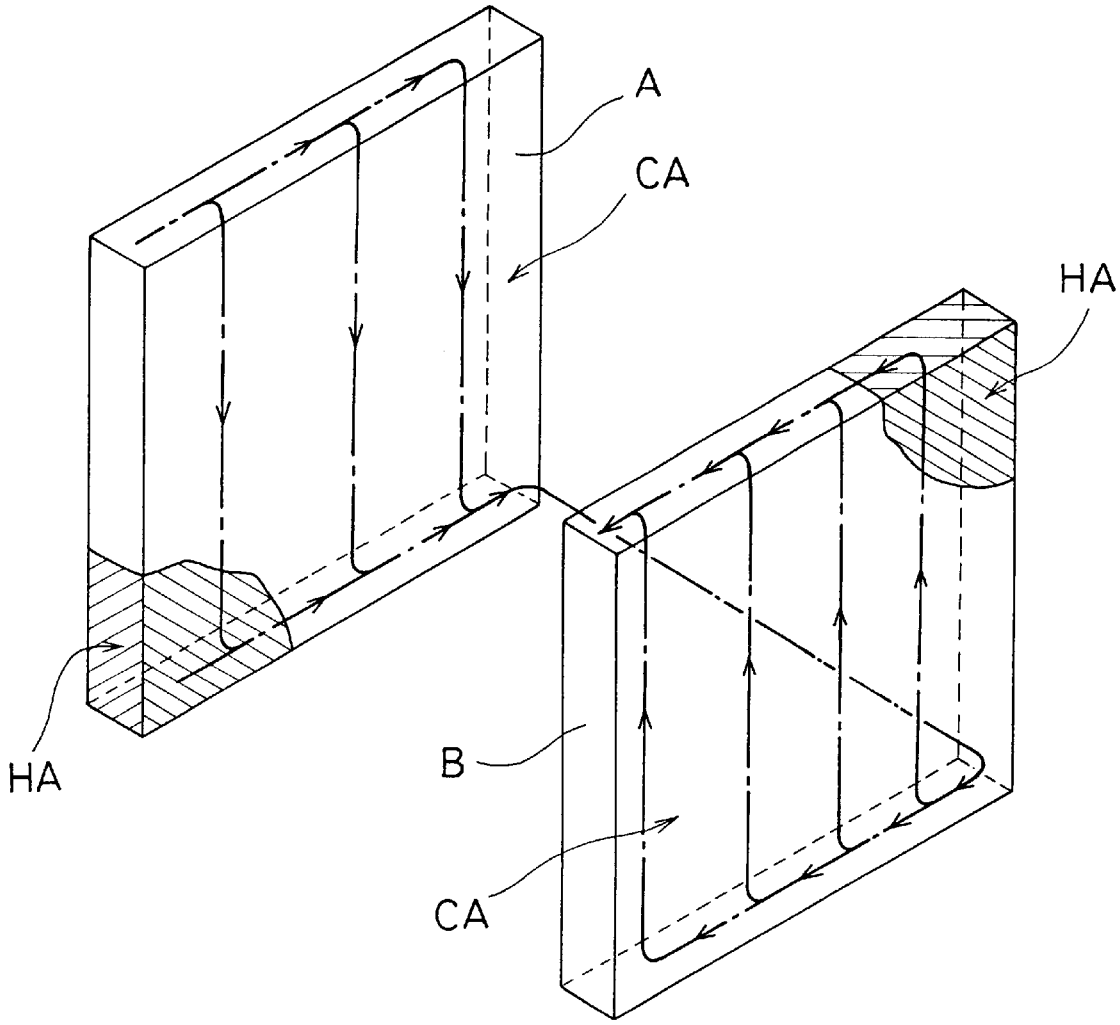
FIG. 3 illustrates the high-temperature areas in a first coolant passage group and a second coolant passage group.

As the coolant travels as described above, the coolant moving inside the first tank group 11 moves inward due to the force with which it has followed in through the coolant inflow pipe 15 as illustrated in FIG. 3, and thus, the quantity of coolant flowing through the first coolant passages 6 located toward the front is small, resulting in a high temperature increase rate due to heat absorption, which creates an area HA where the temperature is high at the bottoms of the first coolant passages 6 located toward the front along the direction in the figure in which the coolant flows in. Likewise, since the coolant having flowed into the third tank group 13 via the coolant bypass passage 19 sequentially passes through the second coolant passages 7 while moving inside the third tank group 13, the quantity of coolant passing through the second coolant passages 7 located toward the front relative to the direction of coolant inflow is small, resulting in a high temperature increase rate, thereby creating an area HA where the temperature is high lo at the tops of the second coolant passages 7 located toward the front along the direction of coolant inflow in the figure. It is to be noted that CA indicates an area where the temperature is low in contrast to the areas where the temperature is high.

However, in the heat exchanger 1 according to the present invention, in which the area HA where the temperature is high in the first coolant passage group A and the area CA where the temperature is low in the second coolant passage group B are aligned along the direction of airflow, and the area HA where the temperature is high in the second coolant passage group B and the area CA where the temperature is low in the first coolant passage group A are aligned along the direction of airflow, overall temperature distribution consistency is achieved for the heat exchanger. It is to be noted that in FIG. 2, the arrow F indicates the direction of air passing through the heat exchanger 1.

Figure 4:
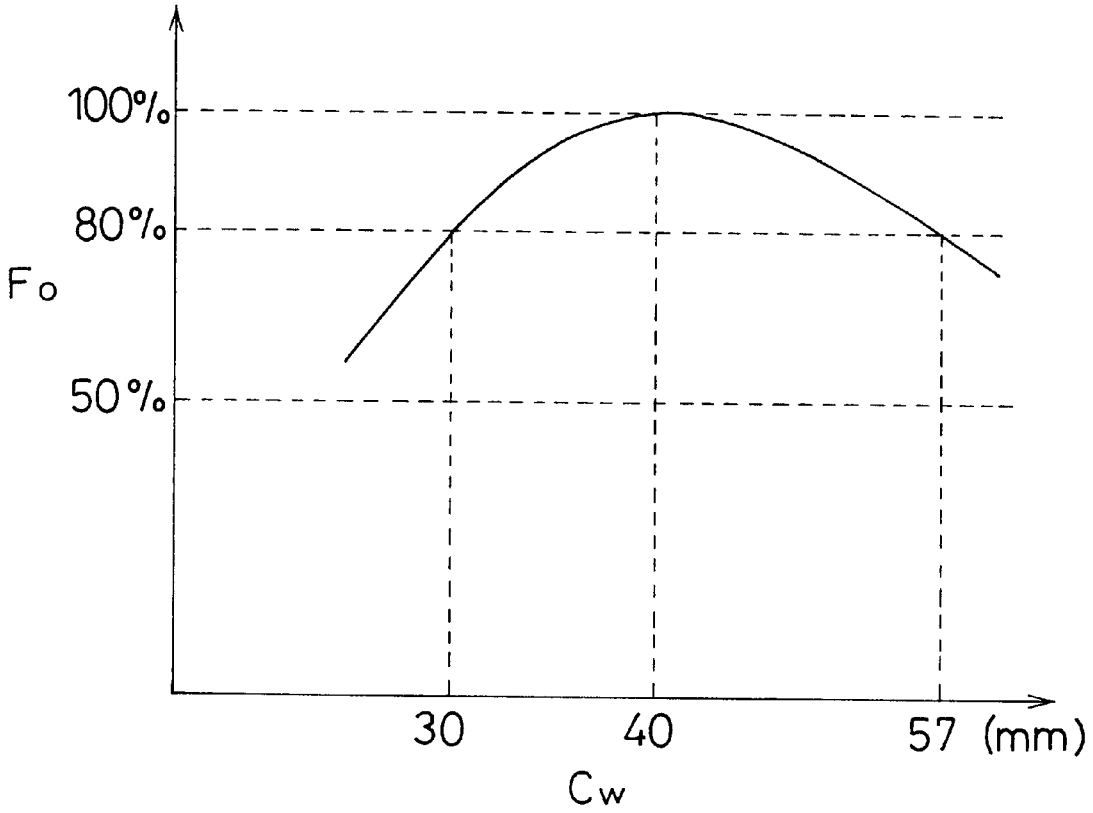
FIG. 4 is a characteristics diagram presenting the relationship between the width Cw of the heat exchanger along the direction of airflow and the heat exchanger capability Fo obtained through testing.

FIG. 4 presents a characteristics diagram of the heat exchanging capability of the heat exchanger 1 structured as described above, indicated as a factor Fo which represents the freezing capability/airflow resistance obtained through testing. The results shown in FIG. 4 indicate that when the width Cw of the heat exchanger along the direction of airflow is set in the range of 30–57 mm, the heat exchanger functions at 80% or higher of the maximum heat exchanging capability (when the width is set at approximately 40 mm).

Figure 5:
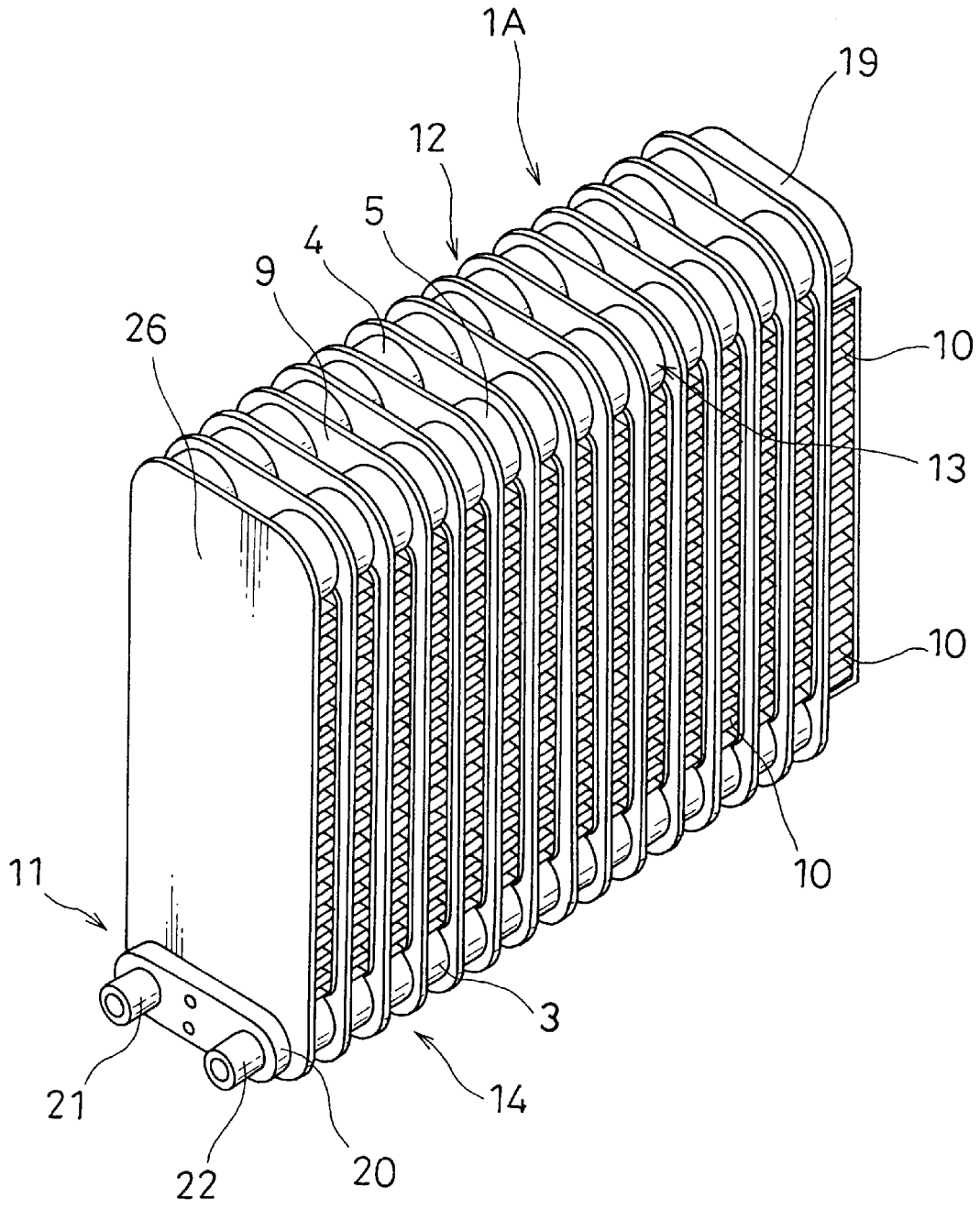
FIG. 5 is a perspective of the heat exchanger in a second embodiment of the present invention.

In a heat exchanger 1A in the second embodiment illustrated in FIG. 5, a flat plate 26 is provided at one end along the laminating direction, and through holes (not shown) are formed at one end, i.e., the lower end in this embodiment, so that a coolant intake pipe 21 communicating with the first tank group 11 and a coolant outlet pipe 22 communicating with the fourth tank group 14 are directly connected and secured to the heat exchanger at the through holes. In addition, a holding plate 20 for holding and securing a block-type expansion valve (not shown) which is to communicate with the coolant intake pipe 21 and the coolant outlet pipe 22 is provided at the coolant intake pipe 21 and the coolant outlet pipe 22. It is to be noted that in the embodiment, the coolant intake pipe 21, the coolant outlet pipe 22 and the holding plate 20 are formed as an integrated unit.

Figure 6:
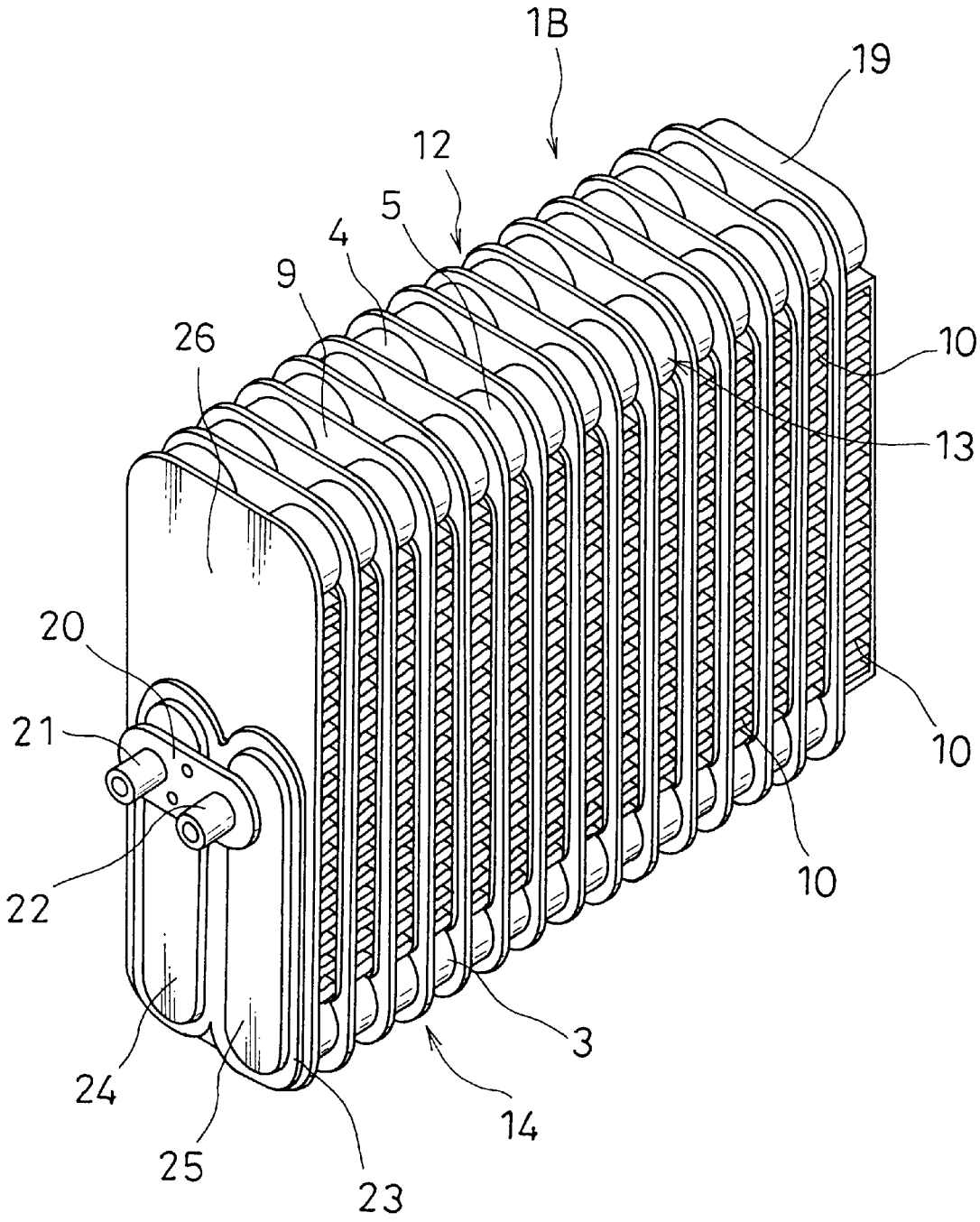
FIG. 6 is a perspective of the heat exchanger in a third embodiment of the present invention.

In a heat exchanger 1B in the third embodiment illustrated in FIG. 6, the flat plate 26 is secured to an intake/outlet passage plate 23 to form an intake passage 24 communicating with the first tank group 11 and an outlet passage 25 communicating with the fourth tank group 14. Thus, the coolant intake pipe 21 and the coolant outlet pipe 22 provided as integrated parts of the holding plate 20 can be set at specific positions of the flat plate 26 via the intake passage 24 and the outlet passage 25.

It is to be noted that the same reference numbers are assigned to components of the heat exchangers 1A and 1B in the second and third embodiments achieving identical structural features or identical functions to those in the first embodiment to preclude the necessity for repeated explanation thereof.

As explained above, in the heat exchanger having a small width along the direction of airflow according to the present invention, in which the partitions at the center of the heat exchanger are eliminated, the first path extending from the first tank group to the second tank group and the second path extending from the third tank group to the fourth tank group are formed and the coolant is made to flow in opposite directions in the first path and the second path, the temperature distribution in the heat exchanger is improved.

In addition, since the tube elements to be laminated can be all is formed identically to one another, productivity is improved. Since there is no risk of erroneous assembly which may occur when assembling different parts, a further improvement in productivity is achieved.

While the invention has been particularly shown and described with respect to preferred embodiments thereof by referring to the attached drawings, the present invention is not limited to these examples and it will be understood by those skilled in the art that various changes in form and detail may be made therein without departing from the spirit, scope and teaching of the invention.

I claim:

1. A heat exchanger comprising:

a plurality of tube elements;

fins laminated between said tube elements along a lamination direction so as to form a body portion having first and second lamination ends along said lamination direction and first and second longitudinal ends along a longitudinal direction of said tube elements;

a coolant intake provided at said first lamination end of said body portion;

a coolant outlet provided at said first lamination end of said body portion; and a bypass passage provided at said second lamination end of said body portion;

wherein each of said tube elements comprises first and second tank portions at said first longitudinal end, third and fourth tank portions at said second longitudinal end, a first coolant passage communicating between said first and third tank portions and a second coolant passage communicating between said second and fourth tank portions;

wherein, for each of said tube elements, said first and second tank portions are separate and discrete from each other, and said third and fourth tank portions are separate and discrete from each other;

wherein said first tank portions communicate with one another to form a first tank group at said first longitudinal end of said body portion;

wherein said third tank portions communicate with one another to form a second tank group at said second longitudinal end of said body portion;

wherein said fourth tank portions communicate with one another to form a third tank group at said second longitudinal end of said body portion;

wherein said second tank portions communicate with one another to form a fourth tank group at said first longitudinal end of said body portion;

wherein said bypass passage communicates between said second and third tank groups;

wherein said coolant intake communicates with said first tank group;

wherein said coolant outlet communicates with said fourth tank group;

wherein said first coolant passages together constitute a first pass between said first and second tank groups, and said second coolant passages together constitute a second pass between said third and fourth tank groups, whereby said heat exchanger constitutes a two-pass heat exchanger;

wherein said bypass passage is disposed at said second longitudinal end of said body portion; and wherein said coolant intake and said coolant outlet are disposed at said first longitudinal end of said body portion.

2. A heat exchanger according to claim 1, wherein said body portion has a width, along an airflow direction, in a range of 30–57 mm.

3. A heat exchanger comprising:

a plurality of tube elements;

fins laminated between said tube elements along a lamination direction so as to form a body portion having first and second lamination ends along said lamination direction and first and second longitudinal ends along a longitudinal direction of said tube elements;

a coolant intake provided at said first lamination end of said body portion;

a coolant outlet provided at said first lamination end of said body portion; and a bypass passage provided at said second lamination end of said body portion;

wherein each of said tube elements comprises first and second tank portions at said first longitudinal end, third and fourth tank portions at said second longitudinal end, a first coolant passage communicating between said first and third tank portions and a second coolant passage communicating between said second and fourth tank portions;

wherein, for each of said tube elements, said first and second tank portions are separate and discrete from each other, and said third and fourth tank portions are separate and discrete from each other;

wherein said first tank portions communicate with one another to form a first tank group at said first longitudinal end of said body portion;

wherein said third tank portions communicate with one another to form a second tank group at said second longitudinal end of said body portion;

wherein said fourth tank portions communicate with one another to form a third tank group at said second longitudinal end of said body portion;

wherein said second tank portions communicate with one another to form a fourth tank group at said first longitudinal end of said body portion;

wherein said bypass passage communicates between said second and third tank groups;

wherein said coolant intake communicates with said first tank group;

wherein said coolant outlet communicates with said fourth tank group;

wherein said bypass passage is disposed at said second longitudinal end of said body portion; and wherein said coolant intake and said coolant outlet are disposed at said first longitudinal end of said body portion.

4. A heat exchanger according to claim 3, wherein said body portion has a width, along an airflow direction, in a range of 30–57 mm.

* * * * *